United States Patent [19]

Van Horne

[11] 4,229,114

[45] Oct. 21, 1980

[54] MECHANISM FOR OPERATOR-REPLACEABLE PRINTHEAD

[75] Inventor: Arthur C. Van Horne, Santa Clara, Calif.

[73] Assignee: Dataproducts Corporation, Woodland Hills, Calif.

[21] Appl. No.: 11,385

[22] Filed: Feb. 12, 1979

[51] Int. Cl.[3] ..... B41J 29/00

[52] U.S. Cl. ..... 400/692; 400/124; 400/175

[58] Field of Search ..... 400/119, 120, 124, 56, 400/57, 59, 175, 320, 352, 692

[56] References Cited

U.S. PATENT DOCUMENTS

| | | | |
|---|---|---|---|
| 3,828,908 | 8/1974 | Schneider | 400/124 |
| 3,921,780 | 11/1975 | Gentzlinger | 400/175 |
| 3,958,254 | 5/1976 | Okabe | 400/175 X |
| 3,990,560 | 11/1976 | Pavliscak et al. | 400/124 X |
| 4,016,965 | 4/1977 | Wirth et al. | 400/124 |
| 4,134,695 | 1/1979 | Randolph | 400/124 X |

*Primary Examiner*—Paul T. Sewell

[57] ABSTRACT

Disclosed is a mechanism for mounting a print head or like device to the shuttle of a printer. The mechanism includes means for securely fastening the print head to the shuttle and is designed to facilitate easy removal and replacement of the print head. The print head includes a cylindrical head section and a generally tapering guide section and has a pair of wedge-shaped locking fins integrally molded on opposite side of the guide sections. In addition, a pair of bosses are molded on the guide section a spaced distance from the locking fins. The shuttle includes a generally upright member having an opening through which the guide section is insertable, and includes two slots whose shape corresponds to that of the molded bosses. The bosses fit into the slots and secure the print head into the proper operating alignment. A releasable retaining assembly is mounted on the shuttle and includes two locking members adapted for clamping engagement with the locking fins. Bias spring means are utilized to urge the locking members into clamping engagement with the locking fins so as to urge the cylindrical head section into tight abutting relationship with the upright member of the shuttle.

15 Claims, 3 Drawing Figures

MECHANISM FOR OPERATOR-REPLACEABLE PRINTHEAD

BACKGROUND AND SUMMARY OF THE INVENTION

The present invention relates to a print head mechanism which is utilized in a high speed printer. More specifically, the present invention relates to a print head mechanism which facilitates easy replacement of the print head and provides for secure positioning of the print head in its operating position.

High speed printers typically utilize a wire matrix print head to perform actual printing function. One typical print head is shown in U.S. Pat. No. 4,051,941 to Hebert, and another is shown in U.S. Patent application Ser. No. 805,706 to Wolf and Slade, filed June 13, 1977 and assigned to Dataproducts Corporation, the same assignee as the present application, the disclosures of which are herein incorporated by reference. In such systems, a plurality of wire stylii are forced against an inked ribbn by means of electromagnetic actuations, thereby imprinting a matrix of minute dots on a printing medium. The symbol which is printed is determined by what stylii of the matrix are forced against the ribbon. The print head is mounted on a shuttle mechanism which traverses the printing medium at a high rate of speed. Because of its rapid rate of operation and wear on the stylii, the print head has a relatively short life when compared to the remainder of the high speed printer, and thus requires periodic replacement. This need for replacement causes two problems to arise. The initial problem is that of ease of replacement. Secondly, and more important, is the fact that the print head must be accurately aligned in the shuttle in order to function properly. The print head must be designed to allow alignment when it is initially mounted, and it must keep this alignment over the period of time for which it is to be used (if periodic adjustment is to be avoided).

With the mounting techniques currently used, quite frequently special tools are required to mount the print head onto the moveable carriage shuttle. In addition, after the print head has been mounted and operation of the printer begun, subsequent adjustments are often needd to properly align the newly installed print head. This is not only expensive, but requires an undue amount of time for the printer operator.

In U.S. Pat. No. 3,921,780 to Gentzlinger and Mailer, a mounting assembly for a print head is set out that does away with need for special tooling, (i.e. a screwdriver may be used). This mounting assembly invloves the use of a circular mounting plate and a ratcheted knob or locking element. It requires that the print head have two accurately aligned mounting studs and one mounting screw. The need for special tools is eliminated, but the assembly still requires that the operator align the print head studs and screw with the corresponding openings in both the carriage and the circular mounting clamp. The mounting clamp must then be rotated and the ratcheted knob threaded on to the mounting screw. Thus, this mounting assembly still tends to be somewhat time consuming. More importantly, though, is the fact that the print head housing, which is normally fabricated from plastic so as to provide a relatively light weight assembly, must be fabricated to include integrally mounted metal studs and a screw. This not only raises the cost of fabricating the print head housing, but also adds undesirable weight to the print head.

The present invention is designed to provide a simple and effective means for mounting and securing a print head to the shuttle of a carriage. The print head includes a cylindrical actuator housing and a tapering guide section or wire guide housing which is attached to the cylindrical actuator housing. A pair of wedge-shaped locking fins are molded on oposite side of the guide section, and a pair of alignment bosses are molded on the guide section a spaced distance from the locking fins. The shuttle includes a generally upright member which includes an opening through which the guide section is inserted. The opening includes a pair of slots which are designed to mate with the the molded bosses so as to rotationally align the print head in the proper operating position. A releasable retaining assembly is mounted on the shuttle and includes a pair of locking members adapted for clamping engagement with the locking fins. Bias spring means are located within the retaining assembly for urging the locking members into clamping engagement with the locking fins. The force exerted by the spring bias means via the locking members and the locking fins urges the cylindrical head section into tight abutting relationship with the upright member of the shuttle. Insertion and removal is thus accomplished quickly and easily simply by releasing the retaining assembly, pulling the print head back until the bosses are free from the slots in the shuttle, and then lifting the print head up through the opening in the shuttle. The bosses serve to properly align the print head in the shuttle and the locking fins serve to hold the print head securely to the shuttle during operation of the printer.

It is therefore a general object of the present invention to provide a mounting assembly whereby a print head is firmly and easily affixed to the printer shuttle without the need of special tools.

It is another object to provide a mounting assembly that requires only the initial positioning of the print head with no subsequent alignment adjustments being required.

It is a further object of the invention to provide a print head wherein all necessary alignment or securing devices may be integrally molded as part of the print head.

DETAILED DESCRIPTION OF THE DRAWINGS

Figure 1:
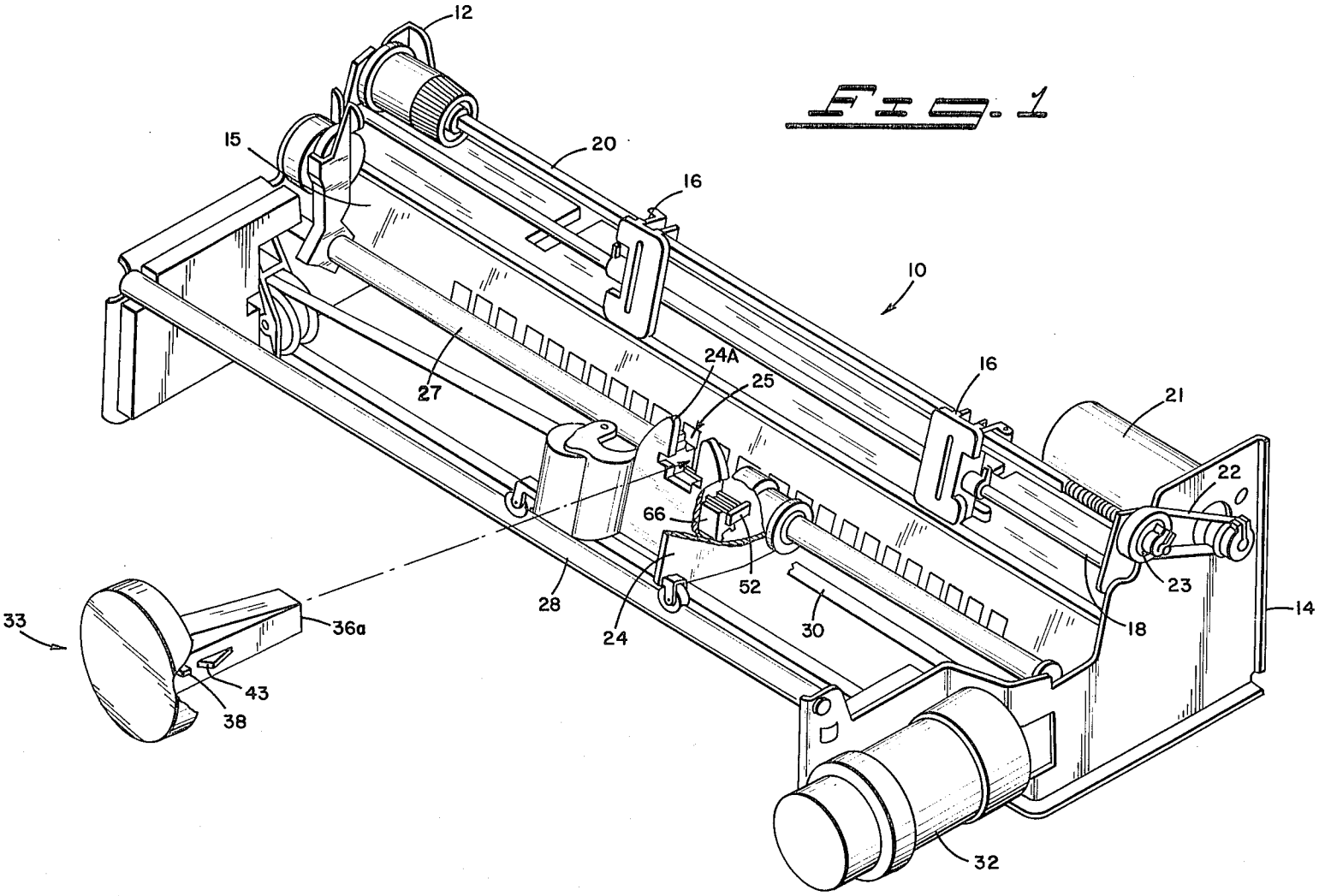
FIG. 1 is a perspective view of a printer mechanism, showing the moveable shuttle upon which the inventive print head replacement mechanism is mounted.

Referring to FIG. 1, a printer mechanism 10 includes a left frame 12 and a right frame 14. A platen 15 is connected between the left frame 12 and the right frame 14 and serves to provide backing support for a printing medium such as paper (not shown). The printing medium is pulled across the platen 15 in a vertical direction by means of two paperfeed tractors 16, which are located upon a support shaft 18 which extends between the left frame 12 and the right frame 14. A drive shaft 20, which is connected to the paper feed tractors 16 and between the left frame 12 and the right frame 14, is rotated so as to cause the printing medium to be pulled up through the paper feed tractors 16. The drive shaft 20 is driven by means of a stepper motor 21 via a drive belt 22 and a drive pulley 23, which is connected directly to the drive shaft 20. The stepper motor assembly is attached to the right frame member 14.

An upright member 24a which is located on a shuttle assembly 24 includes an opening 25 which is adapted to accept a print head 33. The mating action between the print head 33 and the shuttle 24 will be described subsequently. A pair of guide rails 27 and 28 are attached between the left frame 12 and the right frame 14 and provide support for the shuttle 24. During printing, the shuttle 24 is driven across the guide rails 27 and 28 by means of a shuttle drive belt 30, which is driven by a shuttle drive motor 32.

Figure 2:
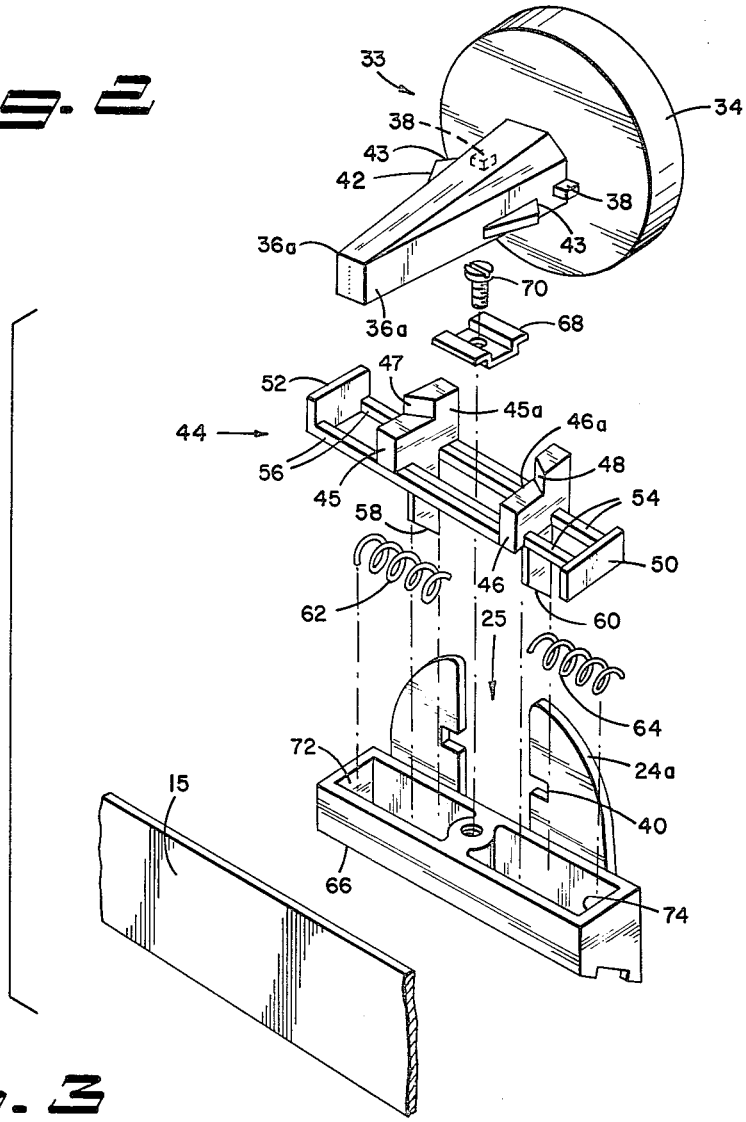
FIG. 2 is an exploded perspective view of a print head and the inventive mechanism for print head replacement.

Referring now to FIG. 2, the print head 33 includes a cylindrical actuator housing or head section 34 and a generally tapering guide section 36, with opposite surfaces 36a which is connected to the housing 34. A pair of bosses 38 are integrally molded on the guide section surfaces 36a and are utilized for locating the print head 33 in the shuttle 24 and for preventing any rotational movement of the print head 33, i.e., they provide for correct operational alignment. The shuttle member 24a includes a pair of slots 40 located on adjacent sides of the opening 25. The slots 40 are designed to mate with the bosses 38. In operation, the print head 33 is lowered into the opening 25 and moved forward towards the platen 15 until the bosses 38 nest within the slots 40. The presence of the slots 40 and the molded bosses 38 thus permit the print head 33 to be located in a fixed operating alignment on the printer shuttle 24.

Referring further to FIG. 2, the guide section 36 includes a pair of wedge-shaped molded projections or fins 42 located on opposite side of the guide section 36 and a spaced distance from each of the molded bosses 38. The molded fins 42 include tapered locking surfaces 43 which face the housing 38 and are utilized in conjunction with a retaining assembly 44 to hold the print head 33 in a tight abutting relationship with the shuttle member 24a when it is inserted into the opening 25. The retaining assembly 44 includes two retaining members 45 and 46 whose inside surfaces 45a and 46a correspond generally to the tapering surfaces 36a of the guide section 36. Each of the locking members 45 and 46 includes a mating or locking surface, designated as 47 and 48, respectively, which is slanted to generally correspond to the angle of the locking surfaces of the wedge-shaped fins 42. The locking surfaces 47 ad 48 are forced towards the fins 42 so as to provide a clamping force on the print head 33. due to the wedge-shape of the fins 42, an inward force upon them results in a multiplied force being applied to the print head 33 in the direction of the platen 15.

Referring further to FIG. 2, the locking member 45 is connected to a handle or finger member 50 via two parallel bar members 54. Likewise, the locking member 46 is connected to a finger member 52 via two parallel bars 56. Each assembly of locking member, bars and finger member forms what is termed a retaining unit. Each of the locking members 45 and 46 includes slots on their lower sides for slidable insertion of the other bar members 56 and 54, respectively. The two retaining units are thus slidably coupled to one another such that forcing the finger members 50 and 52 towards each other will cause the locking members 45 and 46 to spread apart from clamping engagement with the locking fins 42. The combination of the two retaining units forms the retaining assembly 44.

The locking members 45 and 46 each includes an arm, 58 and 60, respectively, depending from the lower surface of the locking members 45 and 46. The retaining assembley 44 is attached to a generally rectangular framed mounting bracket 66 by means of a hold down bracket 68 which fits between the bars 54 and 56, thus preventing vertical movement of the retaining assembly 44. The hold down bracket 68 is attached to the mounting bracket 66 by means of a screw 70. The same screw 70 also attaches the mounting bracket 66 to a tapped hole in the shuttle 24 itself. Thus the retaining assembly 44 is held in a fixed position with respect to the shuttle 24. The retaining assembly 44 is attached to the mounting bracket 66 in such a way that the arms 58 and 60 extend into the interior of the mounting bracket 66. A helical spring 62 is located inside the mounting bracket 66 in such a way that its ends contact the arm 58 and an interior end wall 72 of the bracket 66. Similarly, a spring 64 is positioned between the arm 60 and an interior end wall 74 of the bracket 66. The springs 62 and 64 are compressed and thus tend to force the arms 58 and 60 away from the walls 72 and 74, respectively, thus forcing the locking members 45 and 46 towards one another. When the print head 33 is inserted into the opening 25 of the shuttle 24, the spring bias forces the locking members 45 and 46 towards the tapering guide section 36, causing the locking surfaces 47 and 48 to engage the wedge-shaped fins 42 and thus clamp the print head 33 into position.

Figure 3:
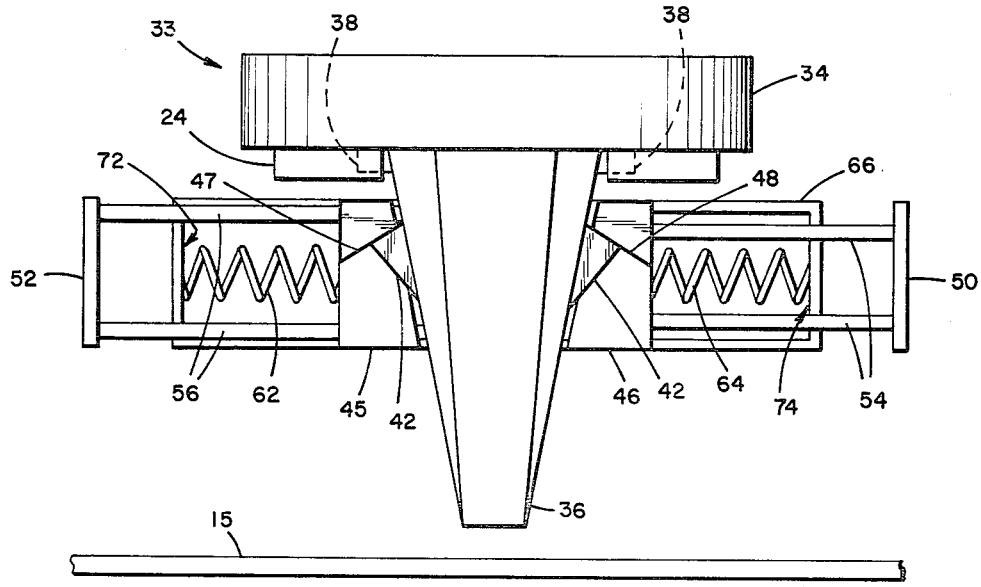
FIG. 3 is a top plan view of the print head replacement and securing mechanism illustrating the clamping and release opertion of the present invention.

Referring no to FIG. 3, it can be seen that the inward force applied by the springs 62 and 64 on the arms 58 and 60 of the locking members 45 and 46 is transferred to the locking fins 42 in such a way that the resultant force tends to move the print head 33 towards the platen 15. This cause the actuator housing 34 to be forced against the upright member of the shuttle 24, thus clamping the print head into a fixed and rigid position with respect to the shuttle 24. In the present embodiment of the invention, the angle of the locking surfaces of the locking fins 36 and the locking surfaces 47 and 48 with respect to the direction of the force exerted by the springs 62 and 64 is eight degrees. Each of the springs 62 and 64 applies approximately two pounds of force on the arms 58 and 60, respectively. This combination of angle and force results in a force of approximately ten pounds holding the print head 33 against the shuttle 24. These values are not critical, but are simply given to illustrate the force multiplication which occurs when the slanted locking surfaces are used. In order to spread the locking members 45 and 46 apart, however, only the force of the springs 60 and 62 (and not the multiplied force) must be overcome. In the present embodiment of the invention, for example, only four pounds of force is required to spread the locking members 45 and 46 apart.

From the foregoing description, it is apparent that the mechansim disclosed provides for both convenient replacement of the print head as well as the secure fastening of the print head into operating position. To remove a print head, the finger members 50 and 52 are grasped and squeezed together, thus causing the locking members 45 and 46 to spread and release the locking surfaces 47 and 48 from engagement with the locking fins 42 on the print head 33. As previously stated, the force required to open the locking members 45 and 46 is relatively low. The print head 33 may then be pulled away from the platen 15 until the bosses 38 are no longer engaged with the slots 40 in the shuttle 24. At this point the print head 33 may then be lifted vertically out of the opening 25. A new print head may then be inserted simply by reversing the steps which were followed for the removal of the old print head. The new print head is lowered into the opening 25 and then forced forward until the bosses 38 engage the slots 40 in the shuttle 24. This aligns the new print head and prevents any rotation from occurring during operation. When a new print head is lowered into the openin 25 the finger members 50 and 52 must be squeezed to spread apart the locking members 45 and 46, and subsequently the locking surfaces 47 and 48 will come into contact with the locking fins 42 and the print head will be secured by means of the pressure applied by the springs 62 and 64.

What is claimed is:

1. A mechansim for mounting a removable print head or like device to the shuttle of a printer, said device including a cylindrical head section and a generally tapering guide section, said mechanism comprising:

a generally upright member on said shuttle, having an opening through which said quide section is insertable, at lest one wedge-shaped projection extending from said guide section, a releasable retaining assembly mounted on said shuttle, including at least one movable locking member adapted for clamping, wedging engagement with said guide section projection, and bias spring means for urging said locking member into clamping engagement with said guide section projection, so that said bias means exerts force via said locking member and said projection to urge said cylindrical head section into tight abutting, rigid relationship with said shuttle upright member.

2. A mechanism for mounting a print head or like device to the shuttle of a printer, said device including a cylindrical head section and a generally tapering guide section, said mechanism comprising:

a generally upright member on said shuttle, having an opening through which said guide section is insertable, at least one projection extending from sad guide section, said projection being a wedge-shaped locking fin that includes an angled locking surface, a releasable retaining assembly mounted on said shuttle, including at least one movable locking memer adapted for clamping engagement with said guide section projection, said locking member being wedge-shaped and including a mating surface sloped to generally correspond to the angle of said fin locking surface, bias spring means for urging said locking member into clamping engagement with said guide section projection, so that said bias means exerts force via said locking member and said projecting to urge said cylindrical head section into tight abutting relationship with said upright member, said mating surface of said locking member being urged into firm contact with said fin locking surface by said bias spring means to produce said clamping engagement.

3. a mechanism according to claim 2 including a handle means coupled to said locking member, for releasing said member from clamping engagement with said projection.

4. A mechanism according to claim 3 wherein said bias spring means comprises a spring member mounted in a generally compressed state between a surface substantially fixed on said shuttle and said movable locking member, the expansion of said spring member against said fixed surface tending to move said locking member into said clamping engagement with said fin, and retain said engagement therebetween.

5. a mechanism according to claim 4 wherein said print head guide section has two locking fins integrally molded thereon, and said retaining assembly includes two corresponding wedge-shaped locking members, and two said spring members, one of said spring members interacting with each of said locking members.

6. A mechanism according to claim 4 wherein said handle means includes a pair of finger members each connected to one of said wedge-shaped locking members by a generally rigid bar member, said finger member, bar member, and locking member comprising an integrally formed retaining unit, said pair of retaining units slideably coupled such that forcing said finger members towards each other operates to spread said locking members apart from clamping engagement with said locking fins, thereby permitting removal of said guide section therefrom.

7. A mechanism according to claim 6 wherein said retaining assembly is comprised of said two opposed slideably mounted retaining units, the locking member of each said retaining unit having an opening for slideable insertion of the bar member of the other retaining unit.

8. a mechanism according to claim 7 comprising:

at least one integrally molded boss extending from said guide section, said boss located a spaced distance from said locking fin, and at least one corresponding mating slot in said upright member of said shuttle, said slot adapted to receive said boss, thereby locating said device in operating alignment on said printer carriage.

9. A mechanism according to claim 8 comprising:

a pair of said bosses, one each extending from opposite sides of said guide sections, and two corresponding mating slots, one each positioned on one side of said opening of said upright member.

10. A self-aligning mechanism for mounting a print head or like device to the shuttle of a printer, said device having an enlarged actuator housing section and an elongated wire guide housing extending therefrom, said mechanism comprising:

a generally upright member on said shuttle, having an opening through which said wire guide housing is insertable, a pair of wedge-shaped projections extending from opposite sides of said guide housing, and a releasable retaining assembly mounted on said shuttle on the platen side of said upright member, including:

first and second opposed slideably mounted locking wedges, and bias spring means for urging said locking wedges toward one another, said guide housing seating between said locking wedges, said wedges in clamping engagement with said wedge-shaped projections, so that said bias means exerts force via said locking wedges and said projections to urge said actuator housing into tight relationship with said upright member.

11. A mechanism according to claim 10 including a handle means coupled to said first and second locking wedges for forcing said opposed locking wedges from clamping engagement with said projections.

12. A mechanism according to claim 11 wherein said handle means includes a pair of finger members each connected to one said wedge-shaped locking members by a generally rigid bar member, said finger member, bar member, and locking member comprising an integrally formed retaining unit, said pair of retaining units slideably coupled such that forcing said finger members towards each other operates to spread said locking members apart from clamping engagement with said locking fins, thereby permitting removal of said guide housing therefrom.

13. A mechanism according to claim 12 wherein said retaining assembly is comprised of said two opposed slideably mounted retaining units, the locking member of each said retaining unit having an opening for slideable insertion of the bar member of the other retaining unit.

14. A mechanism according to claim 13 comprising:

at least one integrally molded boss extending from said guide housing, said boss located a spaced distance from said locking fin, and at least one corresponding mating slot in said upright member of said shuttle, said slot adapted to receive said boss, thereby locating said device in operating alignment on said printer carriage.

15. A mechanism according to claim 14 comprising:

a pair of said bosses, each extending from opposite sides of said guide housing, and two corresponding mating slots, each positioned on one side of said opening of said upright member.

* * * * *